US009165728B2

(12) United States Patent
Zheng

(10) Patent No.: US 9,165,728 B2
(45) Date of Patent: Oct. 20, 2015

(54) ON/OFF SWITCH WITH CONTACTS FOR ELECTRICAL CIRCUITS AND APPLIANCES

(75) Inventor: Chun Kai Zheng, Yueqing (CN)

(73) Assignee: KEDU ELECTRIC CO., LTD, Yueqing (CN)

( * ) Notice: Subject to any disclaimer, the term of this patent is extended or adjusted under 35 U.S.C. 154(b) by 409 days.

(21) Appl. No.: 13/550,173

(22) Filed: Jul. 16, 2012

(65) Prior Publication Data

US 2013/0026024 A1 Jan. 31, 2013

(30) Foreign Application Priority Data

Jul. 27, 2011 (CN) ..... 2011 1 0212166
Jul. 27, 2011 (CN) ..... 2011 2 0268638

(51) Int. Cl.
*H01H 13/56* (2006.01)
*H01H 1/20* (2006.01)
*H01H 13/28* (2006.01)

(52) U.S. Cl.
CPC ..... *H01H 13/56* (2013.01); *H01H 1/20* (2013.01); *H01H 13/28* (2013.01)

(58) Field of Classification Search
CPC ..... H01H 13/56
USPC ..... 200/323, 218, 218.1, 218.2, 321, 322, 200/324, 325, 327, 51.15, 61.77, 413, 538, 200/456, 454, 457, 470, 471, 424–427, 200/429–431, 435
See application file for complete search history.

(56) References Cited

U.S. PATENT DOCUMENTS 7,754,989 B2 * 7/2010 Wong ..... 200/454

* cited by examiner

*Primary Examiner* — Felix O Figueroa
(74) *Attorney, Agent, or Firm* — Colorado Patents

(57) ABSTRACT

A switch with contacts includes a housing formed by snap-fit connection of an upper cover and a base, an operating lever and a movable contact holder, the operating lever and the moveable contact holder being movably-fit to one other. A stop device with a lock mechanism is provided in the housing, the lock mechanism being disposed between the stop device and the movable contact holder. An unlock mechanism is arranged between the stop device and the operating lever. The movable contact holder has positions at each of its two ends with the movable contact holder located in the positions of the two ends. The stop device and the movable contact holder are locked and stopped by the unlock mechanism.

9 Claims, 13 Drawing Sheets

ON/OFF SWITCH WITH CONTACTS FOR ELECTRICAL CIRCUITS AND APPLIANCES

CROSS REFERENCE TO RELATED APPLICATION

The present application claims priority under 35 U.S.C. 119 (a)-(d) to Chinese patent applications Nos. 201110212166.6 and 201120268638.5, which were filed in the Chinese Patent Office on Jul. 27, 2011 and whose subject matter is incorporated herein by reference for all purposes.

TECHNICAL FIELD OF THE INVENTION

The invention relates to a switch for on/off operation of electrical circuits and appliances, particularly a switch with contacts.

BACKGROUND OF THE INVENTION

A conventional contact switch usually includes a housing formed by snap-fit of an upper cover and a base, and an operating lever and a movable contact holder with the operating lever and contact holding being movably-fit to each other. Driven by the operating lever, the switch effects the conversion between the switching-on and switching-off processes by the motion of the movable contact holder inside the housing. Currently available contact switches are unable to initiate the action of returning the switch to the initial off position upon switching-off after switching-on, resulting in serious damage to the contacts and shortened working life of the switches due to slow switching.

SUMMARY OF THE INVENTION

In order to eliminate the above-described disadvantages of conventional contact switches, one object of the present invention is to provide a switch with contacts which is able to initiate the process of returning to the initial off position upon switching-off after switching-on.

The above object is achieved by providing a switch with contacts, including a housing formed by snap-fit of an upper cover and a base, and an operating lever and movable contact holder movably-fit to each other. A stop device is also arranged in the housing, and a lock mechanism is provided between the stop device and the movable contact holder. An unlock mechanism is disposed between the stop device and the operating lever. The movable contact holder has two ends with the movable contact holder located in the position of the two ends. The stop device and movable contact holder are stopped and locked by the unlock mechanism.

An unlock point is set in the operating lever stroke. A proper unlock moment can be achieved by adjusting the unlock point position in the operating lever stroke. After the operating lever reaches the unlock point, the lock mechanism between the stop device and the movable contact holder can be unlocked by the unlock mechanism between the operating lever and the stop device. After the lock mechanism is released, with an elastic element driving the movable contact holder, the operating lever can move inside the housing.

After the switch with contacts is moved from the switching-off state to the switching-on state, the stop device and the movable contact holder are locked, which makes the switch with contacts revert to the switching-off state so that the movable contact holder cannot be set in motion before the unlock mechanism is actuated. After the operating lever moves to an unlock point, the lock mechanism is released by the unlock mechanism between the stop device and the operating lever so that the movable contact holder, actuated by the elastic element between the operating lever and movable contact holder, is set in quick motion. The movable contact on the movable contact holder is quickly separated from the stationery contact on the housing. As a result, the movable contact holder resets to the switching-off state and a "kick-in" function is finally affected.

According to a further embodiments of the preset invention, the stop device includes a stop member, an unlock member, a reset member and a positioning member. A lock mechanism is composed of the stop member and a position-locking member on the movable contact holder that cooperates with the stop member. A resetting force, formed by one end of the reset member pressing the housing, urges the stop member to touch the position-locking member on the movable contact holder so that the lock mechanism is locked. A pressing member, provided on the operating lever, presses against the unlock member and urges the stop member to separate from the position-locking member on the movable contact holder by overcoming the resetting force from the reset member. As a result, an unlock mechanism is formed by unlocking of the lock mechanism According to a further embodiment of the present invention, the stop device includes a stop member, an unlock member, a reset member and a positioning member, which is connected to the limit member on the housing. A lock mechanism is composed of the stop member and a position-locking member on the movable contact holder in collaboration with the former. One end of the reset member, being received in a slot in the operating lever and touching the lever, can slide along with the operating lever. When the reset member moves together with the operating lever to the side where stop member lies, a clockwise resetting force is generated, which urges the stop member to come close to the position-locking member on the movable contact holder so that the lock mechanism is locked and thus stopped; when the reset member moves together with the operating lever to the side where unlock member lies, a counterclockwise unlocking force is formed, which urges the stop member to separate from the position-locking member on the movable contact holder so that the unlock mechanism is formed by the unlock of the lock mechanism.

The positioning member, which is a lever, can turn inside the position-locking member, which is a notch. The reset member is an elastic element. The positioning member, which can alternatively be a straight surface, can slide on the positioning-locking member, which also can be a straight surface. Both the pressing member and the unlock member are inclined surfaces. The two inclined surfaces, pressing each other, form a component force, which balances the resetting force from the reset member.

The positions at both ends of the movable contact holder are switching-on and switching-off positions, respectively.

The movable contact holder, with the present switch put in the switching-on position, is located in the end position. The stop device and the movable contact holder are locked by the lock mechanism.

A movable contact is provided on the movable contact holder and a stationery contact arranged on the housing. With the switch located in the switching-on position, the movable contact and the stationery contact are closed, forming a conductive electrical circuit. With the switch located in the switching-off position, the movable contact is separated from the stationery contact, forming an open circuit.

By adjusting the unlock point to a proper position, less time will be needed for the movable contact holder to move from the switching-on position to the switching-off position inside the housing.

The present invention offers the following distinct advantages over known switching devices: First, the stop device is provided between the operating lever and the movable contact holder. When operating lever travels in its stroke and has not arrived ahead of an unlock point, no separating action will occur. The movable contact holder is locked by the lock mechanism (composed of position-locking member and stop member) via the movable contact holder, urged by the elastic element of the operating lever, producing a rightward separating force. After the operating lever arrives behind an unlock point in its stroke, with the pressing member above the operating lever pressing the unlock member, the stop member 4*a* is forced to separate from the position-locking member, which enables the movable contact holder to begin to make a quick motion under the pressure of the elastic element, causing the movable contact on the movable contact holder to separate from the stationery contact on the housing. Thus, a separating motion is produced. The above-described manner of contact separation is such that the contact separating motion speed is not affected by the operator's manipulation of the operating lever. The contact separating stability is thereby enhanced and the contact working life prolonged, which improves the stability of the present switch.

Second, by the adoption of the lock mechanism on the movable contact holder, a situation can be avoided, in which the switch cannot be turned off due to contact pressure reducing to near zero, with the elasticity of the elastic element changing to a certain degree. The movable contact can be separated from the stationery contact only when the operating lever moves behind the unlock point so that an electrical circuit cannot be broken owing to the contact adhesion resulting from zero separating pressure. Therefore, the switch safety according to the present invention is considerably enhanced by inclusion of this lock mechanism.

Third, with the lock mechanism provided on the movable contact holder, when the switch is put in the process from the switching-off position to the switching-on position, if the movable contact is connected with the stationery contact, the movable contact holder will be locked by the lock mechanism. Therefore, a situation is avoided which the movable contact and the stationery contact are closed once again after their separation, resulting in electric are connected for the second time (which is caused by the separation of the two contacts resulting from the rebounce of the movable contact holder after the holder makes an impact on the housing). This avoidance significantly reduces are erosion to the contacts and prolongs the working life of the contacts and the switch.

Fourth, with the lock mechanism provided on the movable contact holder, the pressure of the present switch contacts in use will not be affected by decreased elasticity of the elastic element and the connecting pressure between the contacts. Furthermore, the safety of the switch can be more reliably guaranteed.

BRIEF DESCRIPTION OF THE DRAWINGS

The invention will now be explained in greater detail with reference to the accompanying drawings wherein.

DETAILED DESCRIPTION OF THE PREFERRED EMBODIMENTS

Figure 1:
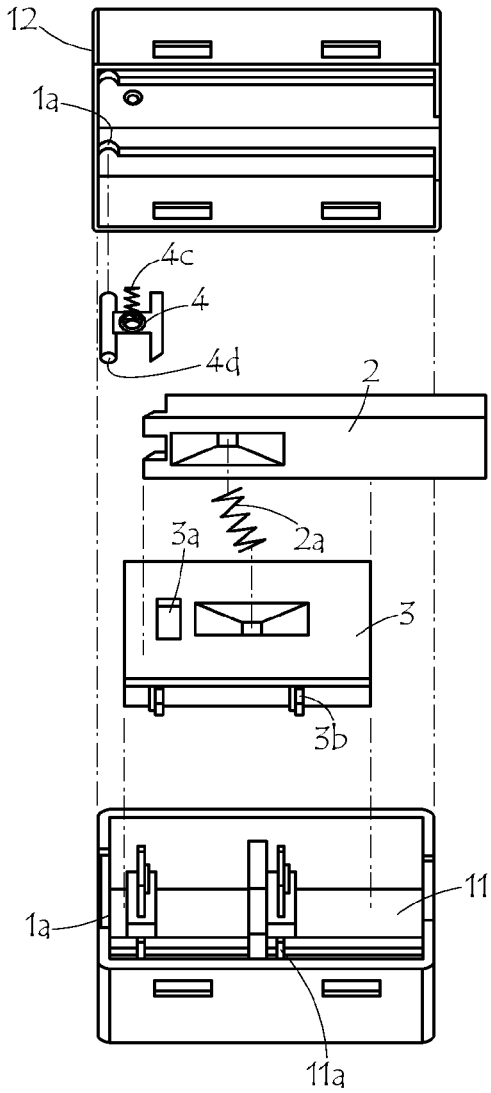
FIG. 1 is an exploded view of the switch housing according to an embodiment of the present invention.
Figure 1A:
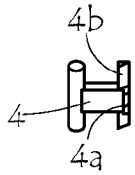
FIG. 1*a* is a perspective view showing the underside of stop device 4 of FIG. 1.
Figure 1B:
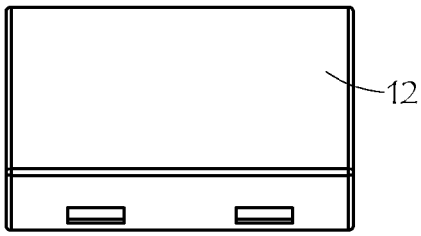
FIG. 1*b* is a perspective view showing the exterior of cover 12 of FIG. 1.
Figure 1C:
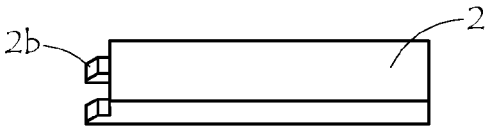
FIG. 1*c* is a perspective view showing the topside of operating lever 2 of FIG. 1.
Figure 1D:
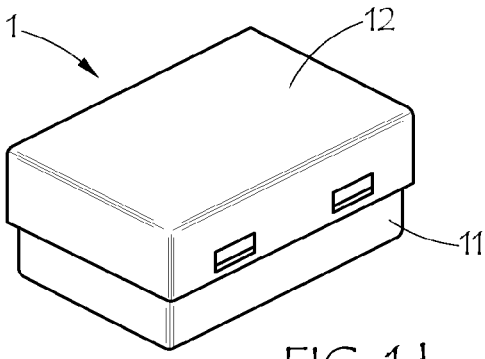
FIG. 1*d* is a perspective view showing the exterior of the switch housing of FIG. 1.
Figure 2:
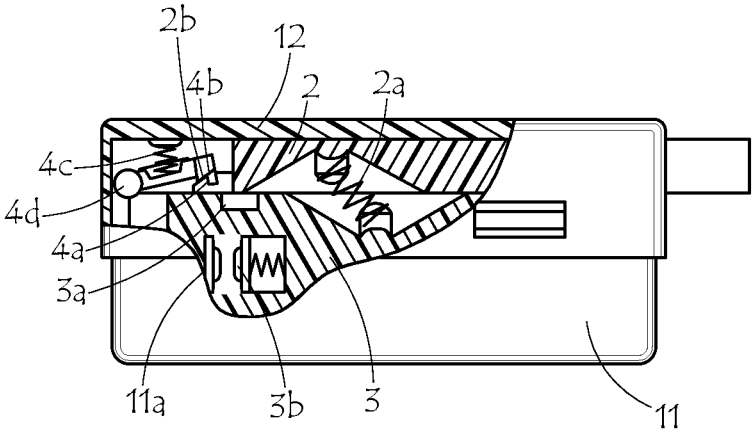
FIG. 2 is a partial sectional view of the contact switch of the present invention in the initial switching-off state.
Figure 3:
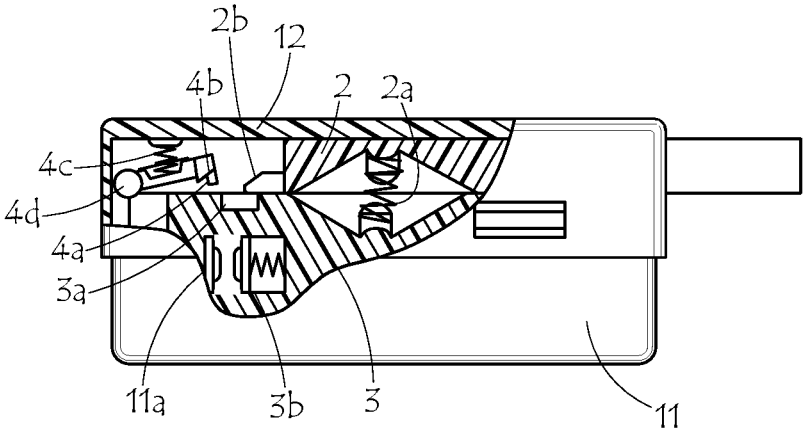
FIG. 3 is a partial sectional view of the contact switch of the present invention in the switching-on process.
Figure 4:
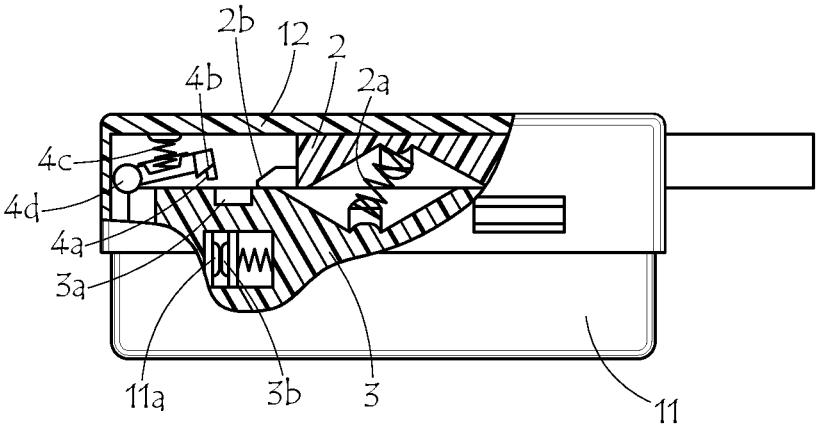
FIG. 4 is a partial sectional view of the contact switch of the present invention in the switching-on state.
Figure 5:
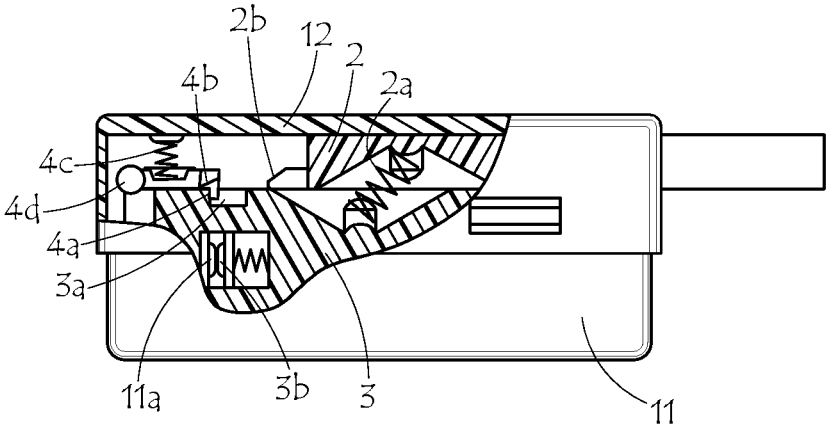
FIG. 5 is a partial sectional view of the contact switch of the present invention after the switching-on state is completed.
Figure 6:
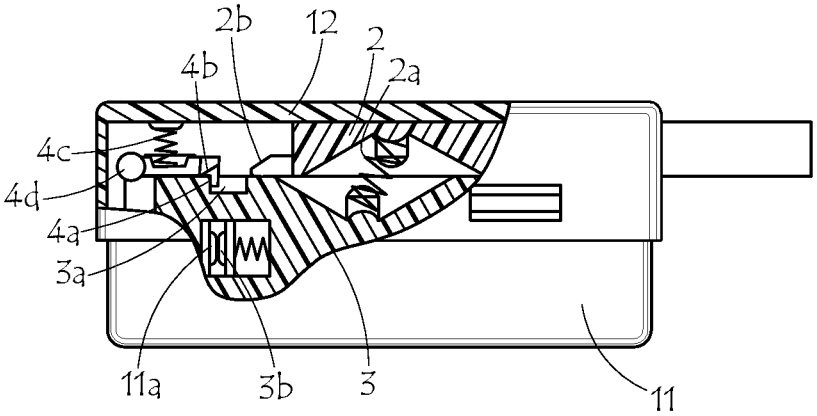
FIG. 6 is a partial sectional view of the contact switch of the present invention in the releasing process.
Figure 7:
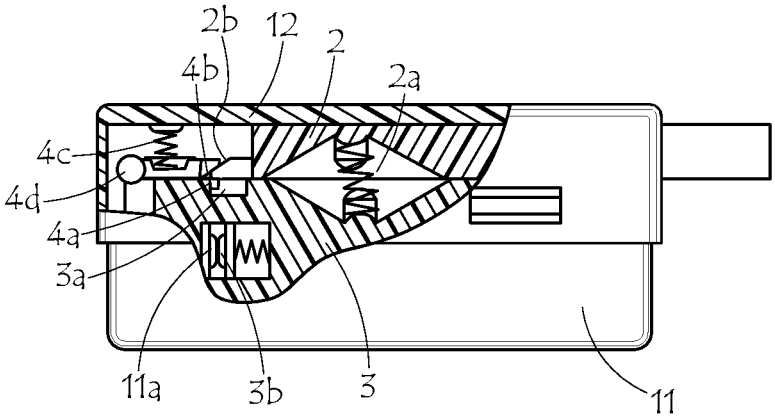
FIG. 7 is a partial sectional view of the contact switch of the present invention in the releasing process and at an unlock point.
Figure 8:
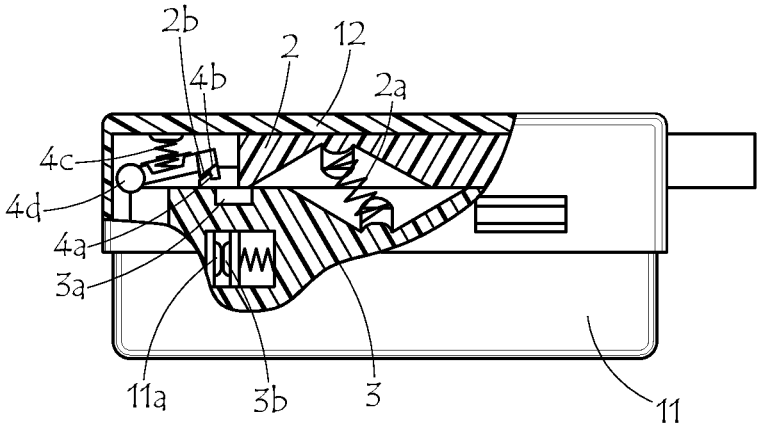
FIG. 8 is a partial sectional view of the contact switch of the present invention in the releasing process and behind an unlock point.
Figure 9:
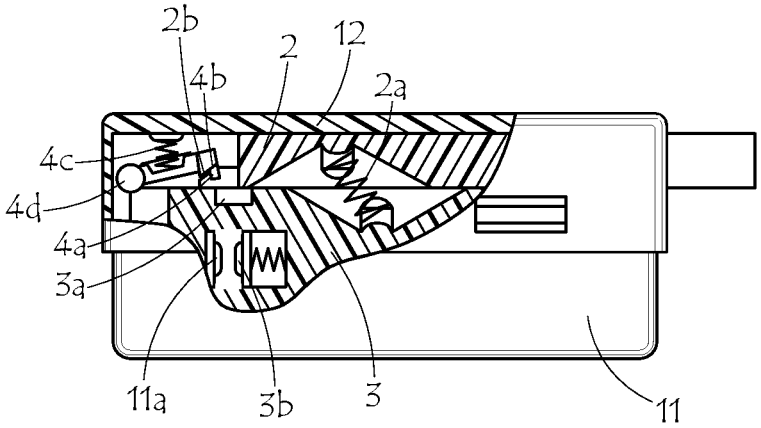
FIG. 9 is a partial sectional view of the contact switch of the present invention: reverting to the initial switching-off state.

Referring now to the figures, a switch with contacts according to the present invention includes a housing 1 formed by snap-fit of an upper cover 12 and a base 11, an operating lever 2, and movable contact holder 3 movably-fit to each other. In the housing, a stop device 4 is provided with a lock mechanism (not numbered) disposed between the stop device 4 and the movable contact holder 3; an unlock mechanism (not numbered) is arranged between the stop device 4 and the operating lever 2; the movable contact holder 3 having positions at its two ends with the movable contact holder 3 located in the positions of the two ends, the stop device 4 and the movable contact holder 3 are locked and stopped by the unlock mechanism. An unlock point is set in the stroke of the operating lever 2. A proper unlock moment can be obtained by adjusting the unlock point position in the stroke of the operating lever 2. After the operating lever 2 reaches the unlock point, the lock mechanism between the stop device 4 and the movable contact holder 3 can be unlocked by the unlock mechanism between the operating lever 2 and the stop device 4. After the lock mechanism between the stop device 4 and the movable contact holder 3 is released, with an elastic element 2*a* driving the movable contact holder 3, the operating lever 2 can move inside the housing. By the above design, when the switch with contacts converts from the switching-off state to the switching-on state, the stop device 4 and the movable contact holder 3 are locked, which puts the switch in the process of reverting to the switching-off state so that the movable contact holder 3 is not set in motion before the unlock mechanism is actuated. After the operating lever 2 moves to an unlock point, the lock mechanism is released by the unlock mechanism between the stop device 4 and the operating lever 2 so that the movable contact holder 3, actuated by the elastic element 2*a* between the operating lever 2 and movable contact holder 3, is set in quick motion, and that the movable contact 3*b* is put in quick separation from the stationery contact 11*a*. As a result, the movable contact holder 3 resets to the switching-off state and kick function is finally affected. The stop device 4, the lock mechanism and the unlock mechanism of the present invention can be set in varied ways.

Exemplary Embodiment 1

As shown in FIG. 1, the dashed arrow near the operating lever 2 indicates another diagram of the same lever 2; the dashed arrow near the stop device 4 points to further diagram of the same stop device 4; the dashed arrow near the upper cover 12 references a further diagram of the same cover 12. The stop device 4 includes a stop member 4*a*, an unlock member 4*b*, a reset member 4*c* and a positioning member 4*d* which is in connection with the limit member 1*a* on the housing 1. A lock mechanism is composed of the stop member 4*a* and a position-locking member 3*a* on the movable contact holder 3, with 4*a* and 3*a* cooperating with each other. One end of the reset member 4*c*, pressing the housing 1, forms a resetting force which urges the stop member 4*a* to come close to the position-locking member 3*a* on the movable contact holder 3 so that the lock mechanism is locked and stopped; a pressing element 2*b* is provided on the operating lever 2. The pressing element 2*b* presses against the unlock member 4*b*, overcomes the resetting force from the reset member 4*c*, and urges the stop member 4*a* to separate from the position-locking member 3*a* on the movable contact holder 3 so that the unlock mechanism is formed by the unlock of the lock mechanism.

With reference to FIG. 2 to FIG. 5, when the switch is moved from the switching-off state to the switching-on state, the operating lever 2 moves rightwards, which under the pressure of the elastic element 2*a*, urges the movable contact holder 3 to move leftwards. When the movable contact holder 3 reaches the switching-on position, the movable contact 3*b* on the movable contact holder 3 becomes connected with the stationery contact 1*a* on the housing 1. The reset member 4*c*, which is a spring, presses against the housing 1, forming a downward counteracting force. After the stop member 4*a* is connected with the position-locking member 3*a*, the stop device 4, which rotates clockwise, prevents the movable contact holder 3 from moving rightwards, affecting the lock of the movable contact holder 3 and the stop device 4.

As shown in FIG. 6 to FIG. 9, when the contact switch is moved from the switching-on state to the switching-off state, the pressure of the elastic element 2*a* urges the movable contact holder 3 to produce a rightward resilient force, while the movable contact holder 3 is not in motion before the stop member 4*a* and the position-locking member 3*a* are separated. After the operating lever 2 travels leftwards to an unlock point, the inclined surface of the pressing member 2*b* presses against the inclined surface of the unlock member 4*b* to balance the resetting force so that the stop member 4*a* and the position-locking member 3*a* are separated, with the result that the movable contact holder 3 and stop device 4 are unlocked. Meanwhile, the movable contact holder 3, urged by the elastic element 2*a* located between the operating lever 2 and the movable contact holder 3, moves rightwards quickly and the movable contact 3*b* and the stationery contact 11*a* are separated quickly. As a result, with the electrical circuit broken and the movable contact holder 3 reverting to the switching-off state, the kick-in function are obtained.

Exemplary Embodiment 2

Figure 10:
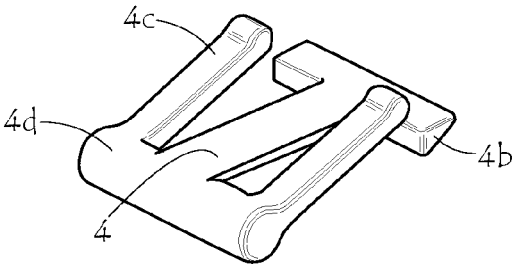
FIG. 10 is a front view of the stop device of the contact switch of a second embodiment of the present invention.
Figure 10A:
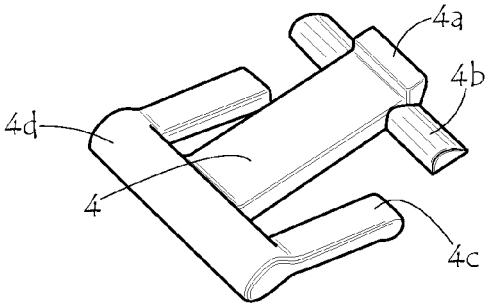
FIG. 10*a* is a perspective view showing the underside of stop device of FIG. 10.
Figure 11:
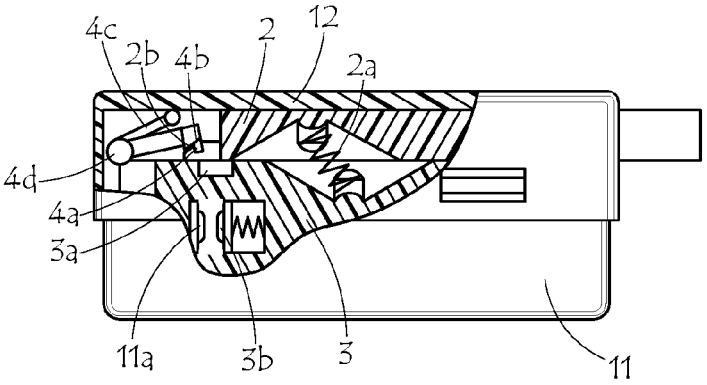
FIG. 11 is a partial sectional view of the contact switch of the second embodiment of the present invention in the initial switching-off state.

In FIG. 10, the dashed arrow near the stop device 4 indicates another view of the device 4. (See FIGS. 1-11, in which the stop device 4 in FIG. 10 is an alternative type to the stop devices 4 in FIGS. 1-11. The reset member 4*c* of the stop device 4 in FIG. 10 is designed as a sheet form for pressing the housing 1, used for generating a clockwise force by the deformation of the sheet form.

Exemplary Embodiment 3

Figure 12:
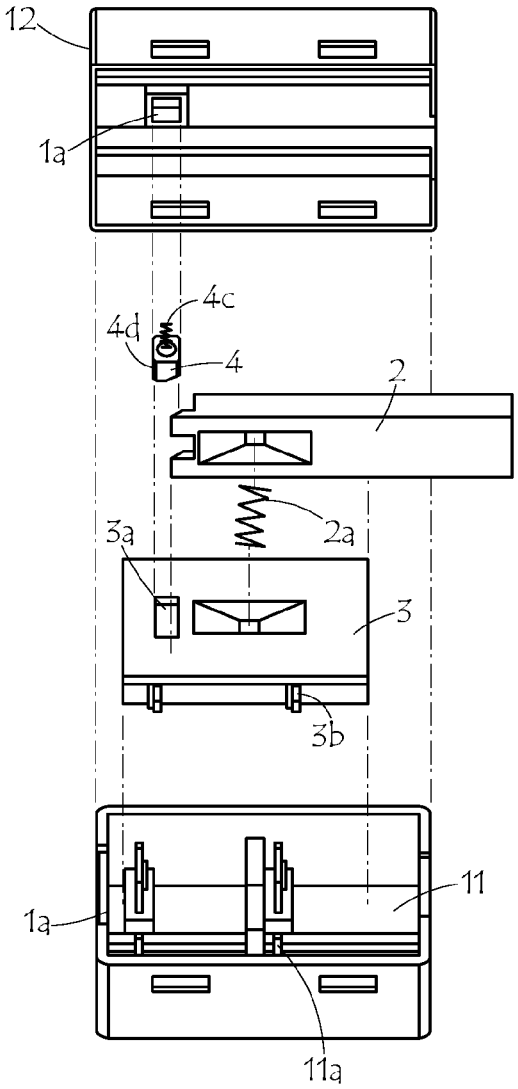
FIG. 12 is a disassembling view of the switch housing of a third embodiment of the present invention.
Figure 12A:
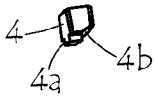
FIG. 12*a* is a perspective view showing the underside of stop device 4 of FIG. 12.
Figure 12B:
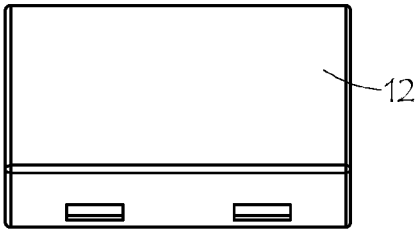
FIG. 12*b* is a perspective view showing the exterior of cover 12 of FIG. 12.
Figure 12C:
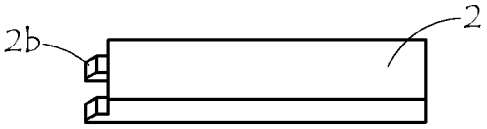
FIG. 12*c* is a perspective view showing the topside of operating lever 2 of FIG. 12.
Figure 12D:
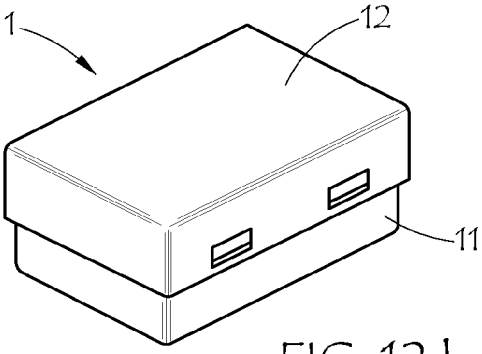
FIG. 12*d* is a perspective view showing the exterior of the switch housing of FIG. 12.
Figure 13:
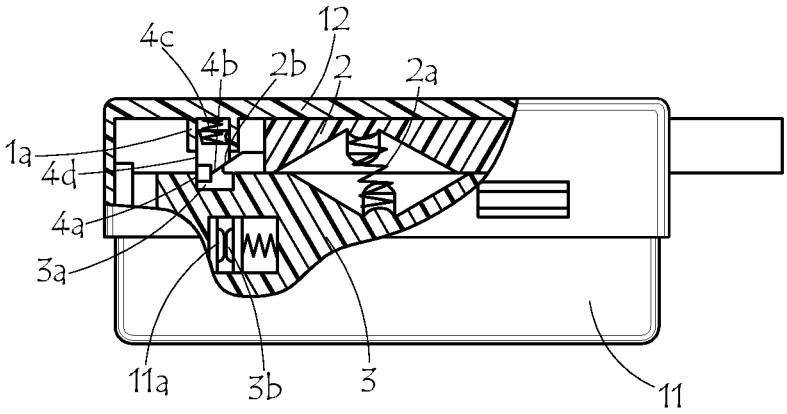
FIG. 13 is a partial sectional view of the contact switch of the third embodiment of the present invention in the separating process.
Figure 14:
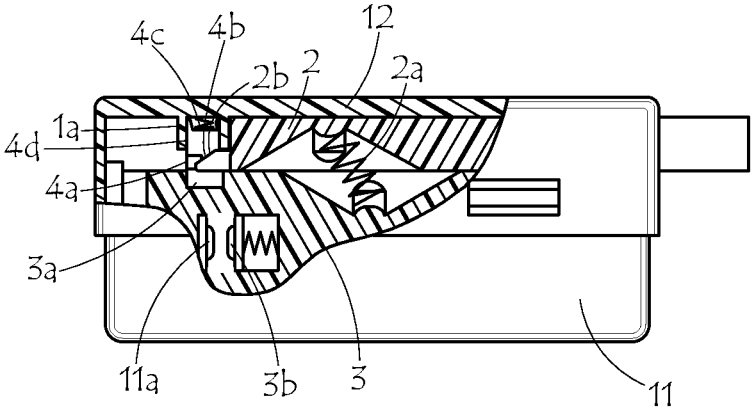
FIG. 14 is a partial sectional view of the contact switch of the third embodiment of the present invention after the separating process.

In FIG. 12, the dashed arrow near the stop device 4 points to another view of the device 4 (see FIGS. 1-9 and 12-14, in which the stop device 4 and the limit member 1*a* of the present embodiment in FIG. 12 are alternative types to the stop devices 4 and the limit members 1*a* in FIGS. 1-9, respectively). The positioning member 4*d* of the present embodiment is designed as a sliding type, rather than a rotational type. The reset member 4*c* presses the housing 1 to produce a downward resetting force and the inclined surface of the pressing member 2*b* presses the inclined surface of the unlock member 4*b* to produce an upward unlocking force The above three exemplary embodiments provide only three types of specific constructions of the stop device 4 and the present invention is not limited to these constructions. Stop devices that are able to produce a resetting force by the reset member 4*c* pressing against the housing 1 to effect, upon the movable contact holder 3 being put in the switching-on state, the lock of the stop device 4 and the movable contact holder 3, and configured to effect the unlock by the pressing member 3*b* pressing against the unlock member 4*b*, upon the operating lever moving leftwards and arriving behind the unlocking point, are all contemplated.

Exemplary Embodiment 4

Figure 15:
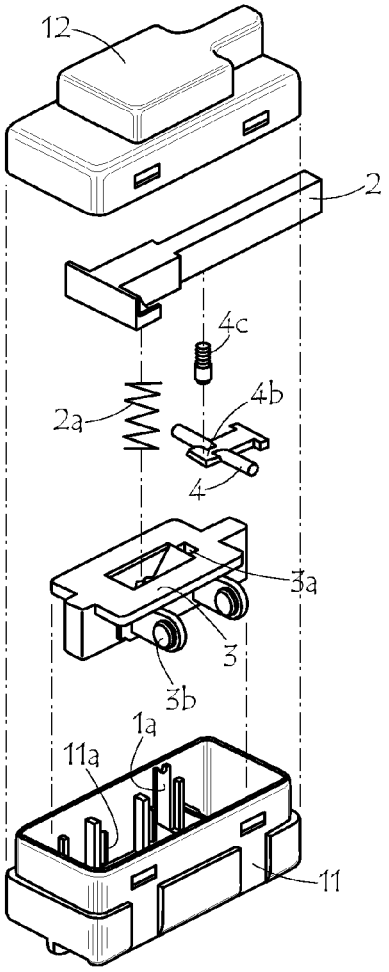
FIG. 15 is a perspective of the contact switch housing of a fourth embodiment of present invention.
Figure 15A:
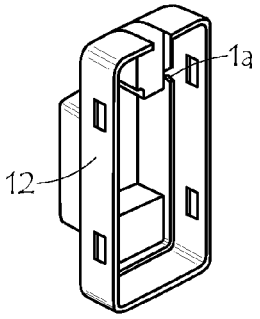
FIG. 15*a* is a perspective view showing the interior of cover 12 of FIG. 15.
Figure 15B:
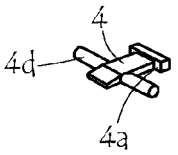
FIG. 15*b* is a perspective view showing the underside of stop device 4 of FIG. 15.
Figure 15C:
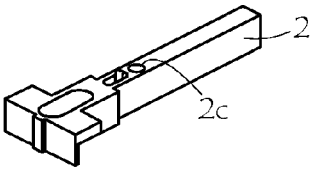
FIG. 15*c* is a perspective view showing the topside of operating lever 2 of FIG. 15.
Figure 15D:
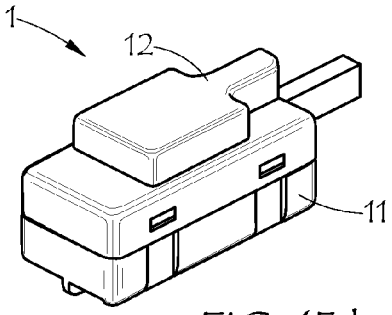
FIG. 15*d* is a perspective view showing the exterior of the switch housing of FIG. 15.
Figure 16:
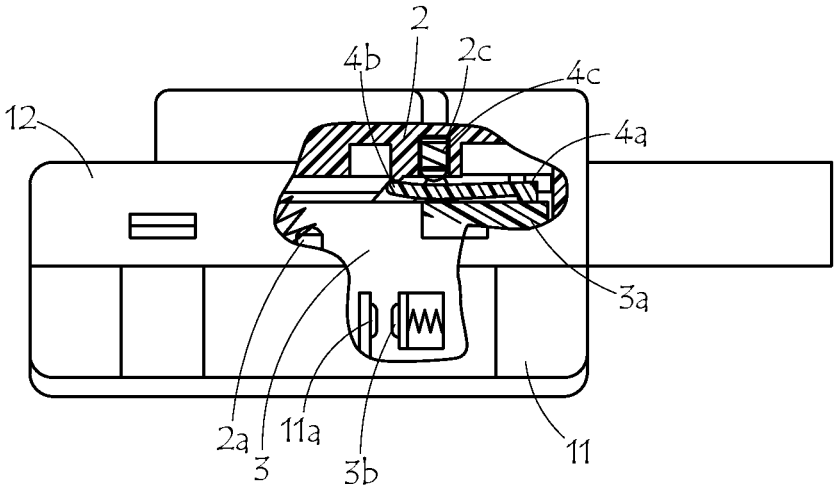
FIG. 16 is a partial sectional view of the contact switch of the fourth embodiment of present invention in the initial open state.
Figure 17:
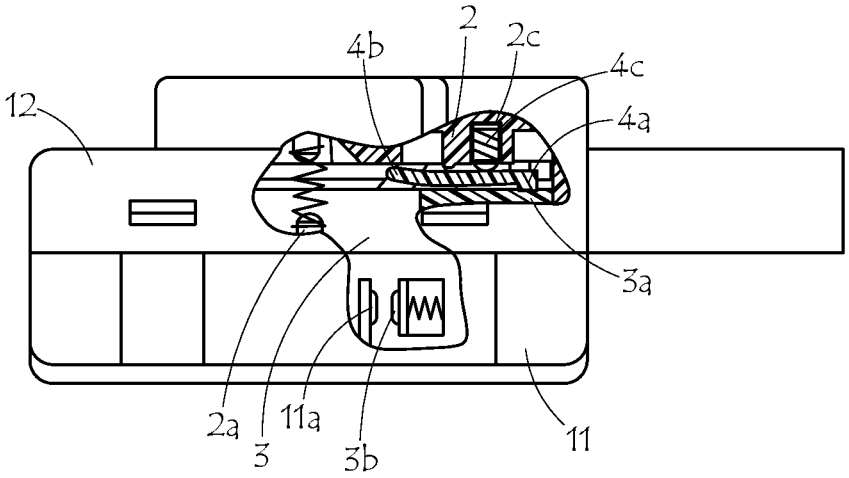
FIG. 17 is a partial sectional view (1) of the contact switch of the fourth embodiment of the present invention in the closing process.
Figure 18:
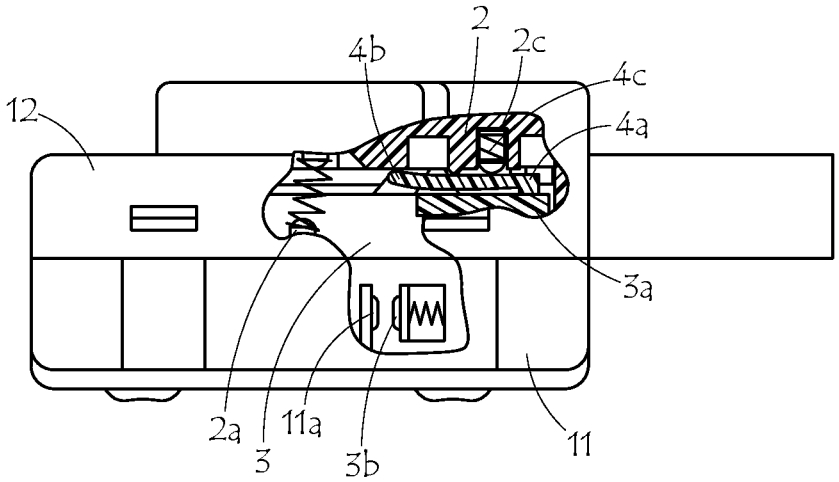
FIG. 18 is a partial sectional view (2) of the contact switch of the fourth embodiment of the present invention in the closing process.
Figure 19:
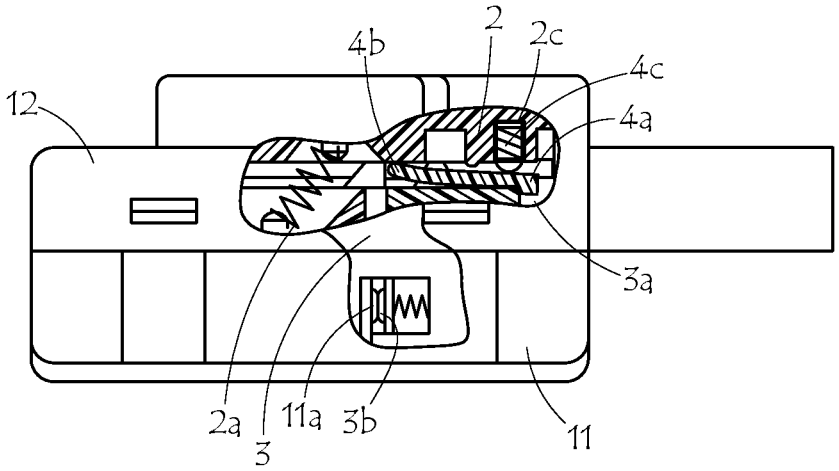
FIG. 19 is a partial sectional view of the contact switch of the fourth embodiment of the present invention in the closing state.

In FIG. 15, the dashed arrow near the operating lever 2 indicates a further diagram of the same lever 2. The dashed arrow near the stop device 4 points to another diagram of the same device 4. The dashed arrow near the upper cover 12 points to another diagram of the same cover 12. The stop device 4 includes a stop member 4*a*, an unlock member 4*b*, a reset member 4*c* and a positioning member 4*d*, which is in connection with the limit member 1*a* on the housing 1. A lock mechanism is composed of the stop member 4*a* and a position-locking member 3*a* on the movable contact holder 3 with 4*a* and 3*a* in cooperation with each other. One end of the reset member 4*c*, pressing the operating lever 2 and being received in a slot 2*c* of the operating lever 2, can move along with the operating lever 2. When the reset member 4*c* moves together with the operating lever 2 to the side where stop member 4*a* lies, a clockwise resetting force is generated, which urges the stop member 4*a* to come close to the position-locking member 3*a* on the movable contact holder 3 so that the lock mechanism is locked and stopped. When the reset member 4*c* moves together with the operating lever 2 to the side where unlock member 4*b* lies, a counterclockwise unlocking force is formed, which urges the stop member 4*c* to separate from the position-locking member 3*a* on the movable contact holder 3, such that the unlock mechanism is formed by the unlock of the lock mechanism.

With reference to FIG. 16 to FIG. 19, when the contact switch is moved from the switching-off state to the switching-on state, the operating lever 2 moves rightwards, which under the pressure of the elastic element 2*a*, urges the movable contact holder 3 to move leftwards. When the movable contact holder 3 reaches the switching-on position, the movable contact 3*b* on the movable contact holder 3 becomes connected with the stationery contact 1*a* on the housing 1. The reset member 4*c*, which is a spring, presses against the operating lever 2, forming a downward counteracting force. After the stop member 4*a* is connected with the position-locking member 3*a*, the stop device 4, which rotates clockwise, prevents the movable contact holder 3 from moving rightwards, affecting the lock of the movable contact holder 3 and the stop device 4.

Figure 20:
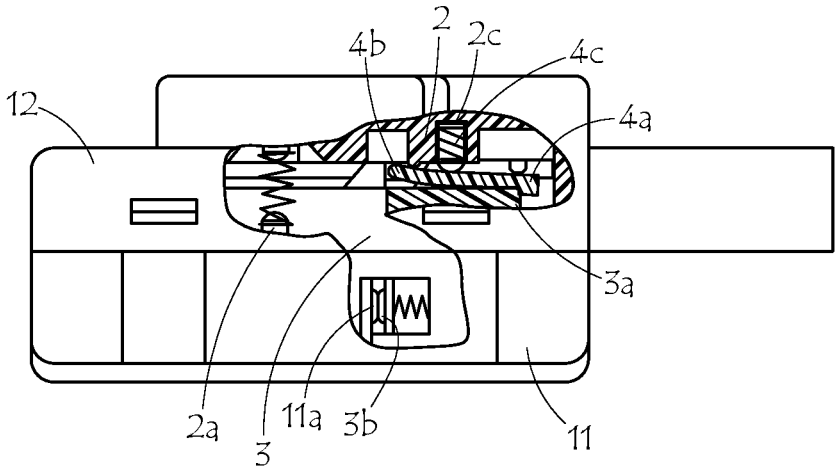
FIG. 20 is a partial sectional view (1) of the contact switch of the fourth embodiment of the present invention in the releasing process.
Figure 21:
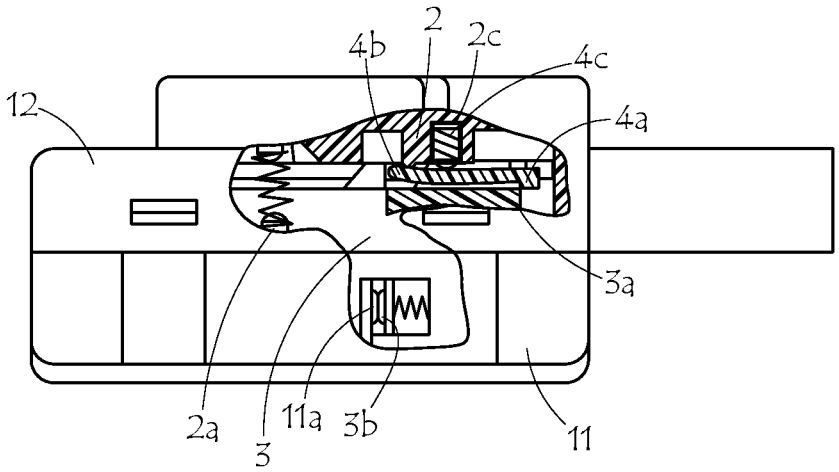
FIG. 21 is a partial sectional view (2) of the contact switch of the fourth embodiment of the present invention in the releasing process.
Figure 22:
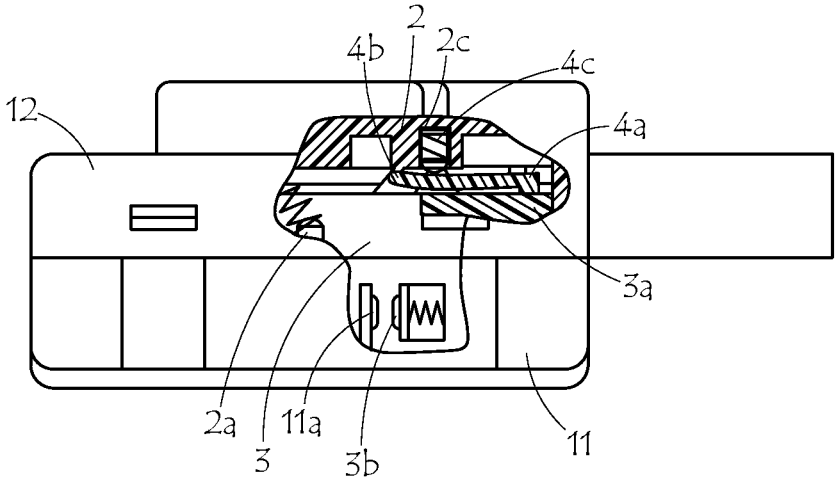
FIG. 22 is a partial sectional view of the contact switch of the fourth embodiment of the present invention reverting to initial open state.

FIG. 20 to FIG. 22, when the contact switch is moved from the switching-on state to the switching-off state, the pressure of the elastic element 2*a* urges the movable contact holder 3 to produce a rightward resilient force, while the movable contact holder 3 is not in motion before the stop member 4*a* and the position-locking member 3*a* are separated. After the operating lever 2 travels leftwards to an unlock point, the inclined surface of the pressing member 2*b* presses against the inclined surface of the unlock member 4*b* to balance the resetting force so that the stop member 4*a* and the position-locking member 3*a* are separated, with the result that the movable contact holder 3 and stop device 4 are unlocked. Meanwhile, the movable contact holder 3, urged by the elastic element 2*a* located between the operating lever 2 and the movable contact holder 3, moves rightwards quickly and the movable contact 3*b* and the stationery contact 11*a* are separated quickly. As a result, with the electrical circuit broken and the movable contact holder 3 reverting to the switching-off state, the kick-in function is obtained.

Exemplary Embodiment 4 provides only one of the specific constructions of the stop device 4 and is not limited to the construction. Embodiments, in which the reset member 4*c* can produce a resetting force by pressing against the operating lever 2 and urge the lock of the stop device 4 and the movable contact holder 3 after the movable contact holder 3 reaches the switching-on state, and unlock is realized by the reset member 4*c* pressing against the unlock member 4*b* after the operating lever 2 travels leftwards to an unlock dot, are all also contemplated.

The above four embodiments provide only one of the specific constructions of the operating lever 2, the movable contact holder 3 and the elastic element 2*a*, and are not limited to the constructions. Other constructional forms, including rotation and swinging, which can affect the connection of the movable contact and the stationery contact by making the operating lever move in one direction, and can realize the separation of the movable contact and the stationery contact by making the operating lever move in another direction as well, are all contemplated.

It will be understood that each of the elements described above, or two or more together, may also find a useful application in other types of constructions differing from the types described above.

While the invention has been illustrated and described as embodied in on/off switch with contacts for electrical circuits and appliances it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A switch with contacts, comprising:

a housing, an operating lever and a movable contact holder, said operating lever and said movable contact holder being movably-fit to one another;

a stop device disposed in the housing including a stop member, an unlock member, a reset member, and a positioning member connected with a limit member on the housing;

a lock mechanism disposed between the stop device and the movable contact holder wherein said lock mechanism is composed of the stop member and a position-locking member provided on the movable contact holder, said stop member and said position-locking member being configured to cooperate with one another, wherein a first end of the reset member presses against the housing to form a resetting force that urges the stop member advance toward the position-locking member on the movable contact holder and wherein the positioning member is a lever and said position-locking member is a notch, wherein said positioning member is configured to turn inside the position-locking member;

wherein the lock mechanism is configured to lock and stop said stop device and movable contact holder, an unlock mechanism arranged between the stop device and the operating lever; wherein an unlock point is positioned in a stroke of the operating lever, wherein a position of said unlock point is adjustable in said stroke of the operating lever, wherein said unlock mechanism is configured to unlock said lock mechanism when the operating lever reaches the unlock point, and wherein said unlock mechanism further comprises a pressing element disposed on the operating lever configured to press against the unlock member, and further configured to overcome the resetting force from the reset member and to urge separation of the stop member from the position-locking member on the movable contact holder, whereby the unlock mechanism is formed by unlocking said lock mechanism; and an elastic element configured to drive the movable contact holder, such that after the lock mechanism is released, the operating lever is movable inside the housing.

2. A switch with contacts, comprising:

a housing, an operating lever and a movable contact holder, said operating lever and said movable contact holder being movably-fit to one another;

a stop device disposed in the housing including a stop member, an unlock member, a reset member wherein the reset member is an elastic element, and a positioning member connected with a limit member on the housing;

a lock mechanism disposed between the stop device and the movable contact holder wherein said lock mechanism is composed of the stop member and a position-locking member provided on the movable contact holder, said stop member and said position-locking member being configured to cooperate with one another, wherein a first end of the reset member presses against the housing to form a resetting force that urges the stop member advance toward the position-locking member on the movable contact holder;

an unlock mechanism arranged between the stop device and the operating lever wherein an unlock point is positioned in a stroke of the operating lever, wherein a position of said unlock point is adjustable in said stroke of the operating lever, wherein said unlock mechanism is configured to unlock said lock mechanism when the operating lever reaches the unlock point, and wherein said unlock mechanism further comprises a pressing element disposed on the operating lever configured to press against the unlock member, and further configured to overcome the resetting force from the reset member and to urge separation of the stop member from the position-locking member on the movable contact holder, whereby the unlock mechanism is formed by unlocking said lock mechanism; and an elastic element configured to drive the movable contact holder, such that after the lock mechanism is released, the operating lever is movable inside the housing.

3. A switch with contacts, comprising:

a housing, an operating lever and a movable contact holder, said operating lever and said movable contact holder being movably-fit to one another;

a stop device disposed in the housing including a stop member, an unlock member, a reset member and a positioning member connected with a limit member on the housing;

a lock mechanism disposed between the stop device and the movable contact holder wherein said lock mechanism is composed of the stop member and a position-locking member provided on the movable contact holder, said stop member and said position-locking member being configured to cooperate with one another, wherein a first end of the reset member presses against the housing to form a resetting force that urges the stop member advance toward the position-locking member on the movable contact holder and wherein each of said positioning member and said position-locking member is a straight surface, and wherein said positioning member is configured to slide on the positioning-locking member;

an unlock mechanism arranged between the stop device and the operating lever wherein an unlock point is positioned in a stroke of the operating lever, wherein a position of said unlock point is adjustable in said stroke of the operating lever, wherein said unlock mechanism is configured to unlock said lock mechanism when the operating lever reaches the unlock point, and wherein said unlock mechanism further comprises a pressing element disposed on the operating lever configured to press against the unlock member, and further configured to overcome the resetting force from the reset member and to urge separation of the stop member from the position-locking member on the movable contact holder, whereby the unlock mechanism is formed by unlocking said lock mechanism; and an elastic element configured to drive the movable contact holder, such that after the lock mechanism is released, the operating lever is movable inside the housing.

4. A switch with contacts, comprising:

a housing, an operating lever and a movable contact holder, said operating lever and said movable contact holder being movably-fit to one another;

a stop device disposed in the housing including a stop member, an unlock member, a reset member and a positioning member connected with a limit member on the housing;

a lock mechanism disposed between the stop device and the movable contact holder wherein said lock mechanism is composed of the stop member and a position-locking member provided on the movable contact holder, said stop member and said position-locking member being configured to cooperate with one another, wherein a first end of the reset member presses against the housing to form a resetting force that urges the stop member advance toward the position-locking member on the movable contact holder and wherein each of said positioning member and said position-locking member is a straight surface, and wherein said positioning member is configured to slide on the positioning-locking member;

an unlock mechanism arranged between the stop device and the operating lever wherein an unlock point is positioned in a stroke of the operating lever, wherein a position of said unlock point is adjustable in said stroke of the operating lever, wherein said unlock mechanism is configured to unlock said lock mechanism when the operating lever reaches the unlock point, and wherein said unlock mechanism further comprises a pressing element disposed on the operating lever configured to press against the unlock member, and further configured to overcome the resetting force from the reset member and to urge separation of the stop member from the position-locking member on the movable contact holder, whereby the unlock mechanism is formed by unlocking said lock mechanism and wherein each of said pressing element and said unlock member is an inclined surface configured to press against one another to form a component force that balances the resetting force from the reset member; and an elastic element configured to drive the movable contact holder, such that after the lock mechanism is released, the operating lever is movable inside the housing.

5. The switch as defined in claim 1, wherein when the lock mechanism is released by the unlock mechanism the elastic element drives the movable contact holder to separate it from the stationery contact on the housing and reset the switch to the switching-off state.

6. The switch as defined in claim 5, wherein the contact separating motion speed is unaffected by the operator's manipulation of the operating lever, thereby prolonging the working life of the contacts.

7. A switch comprising:

a housing having a stationary contact and an operating lever and a movable contact holder movably-fit to one another;

a stop device moveably disposed in the housing;

a lock mechanism disposed between the stop device and the movable contact holder and configured to lock and stop said stop device and movable contact holder in a switching-on state wherein a contact on said movable contact holder is in contact with said stationary contact on said housing;

an unlock mechanism arranged between the stop device and the operating lever and wherein an unlock point is positioned in a stroke of the operating lever such that said unlock mechanism is configured to unlock said lock mechanism when the operating lever reaches the unlock point; and, an elastic element disposed between the operating lever and the moveable contact holder and configured to drive the movable contact holder to separate said movable contact holder from the stationary contact on the housing and reset the switch to a switching-off state when the lock mechanism is released and wherein the operating lever is also movable inside the housing when the lock mechanism is released.

8. A switch comprising:

a housing having a stationary contact and an operating lever and a movable contact holder movably-fit to one another;

a stop device moveably disposed in the housing, said stop device and moveable contact holder cooperating and configured to lock and stop said stop device and movable contact holder in a switching-on state in which a contact on said movable contact holder is in contact with said stationary contact on said housing;

said stop device and operating lever cooperating and configured to unlock said stop device and movable contact holder when the operating lever reaches an unlock point in a stroke of the operating lever; and, an elastic element disposed between the operating lever and the moveable contact holder and configured to drive the movable contact holder to separate said movable contact holder from the stationary contact on the housing and reset the switch to a switching-off state when the stop device and movable contact holder are unlocked and wherein the operating lever is also movable inside the housing when the stop device and movable contact holder are unlocked.

9. The switch as defined in claim 8, wherein the elastic element further urges the moveable contact holder contact into the switching-on state when the operating lever is moved to a switching-on position.

* * * * *